US011911685B1

(12) United States Patent
Anderson et al.

(10) Patent No.: US 11,911,685 B1
(45) Date of Patent: Feb. 27, 2024

(54) SKATEBOARD DECK WITH LONGITUDINAL RIGIDITY AND TORSIONAL FLEXIBILITY

(71) Applicants: Ryan Thomas Anderson, Los Angeles, CA (US); Christopher Riley Cole, Altadena, CA (US); Russell Chilton Hill, II, Los Angeles, CA (US); Ruben McGee Ruckman, Culver City, CA (US); Matthew Adam Wolak, Los Angeles, CA (US)

(72) Inventors: Ryan Thomas Anderson, Los Angeles, CA (US); Christopher Riley Cole, Altadena, CA (US); Russell Chilton Hill, II, Los Angeles, CA (US); Ruben McGee Ruckman, Culver City, CA (US); Matthew Adam Wolak, Los Angeles, CA (US)

(73) Assignee: RXD GLOBAL, LLC, Los Angeless, CA (US)

( * ) Notice: Subject to any disclaimer, the term of this patent is extended or adjusted under 35 U.S.C. 154(b) by 380 days.

(21) Appl. No.: 17/316,934

(22) Filed: May 11, 2021

(51) Int. Cl.
*B62M 1/00* (2010.01)
*A63C 17/01* (2006.01)

(52) U.S. Cl.
CPC ..... *A63C 17/012* (2013.01)

(58) Field of Classification Search
CPC ..... A63C 17/012; A63C 17/017
See application file for complete search history.

(56) References Cited

U.S. PATENT DOCUMENTS

| | | | | |
|---|---|---|---|---|
| 4,337,963 | A * | 7/1982 | Stevenson | A63C 17/01 280/610 |
| 7,077,418 | B2 * | 7/2006 | Heftberger | A63C 5/12 280/610 |
| 7,669,879 | B2 * | 3/2010 | Dykema | A63C 17/01 280/601 |
| 8,382,148 | B2 * | 2/2013 | Dykema | A63C 17/017 280/601 |
| D692,079 | S | 10/2013 | Mackay | |
| 9,827,482 | B2 | 11/2017 | Mackay | |
| 2003/0127816 | A1 * | 7/2003 | Schnuckle | A63C 17/26 280/87.05 |
| 2004/0074205 | A1 * | 4/2004 | Stache | E04C 2/36 52/793.1 |

(Continued)

*Primary Examiner* — Brian L Swenson
(74) *Attorney, Agent, or Firm* — Cislo & Thomas, LLP

(57) ABSTRACT

A skateboard deck that is both stiff in one dimension and flexible in another dimension is disclosed. The deck includes an elongated body characterized by a longitudinal axis, a plurality of ribs, and a plurality of apertures. The plurality of ribs are long, narrow beams oriented substantially parallel to the longitudinal axis and integral with the bottom of the elongated body. The plurality of apertures are distributed in a plurality of rows also oriented substantially parallel to the longitudinal axis. The ribs and rows of apertures are interposed in an alternating pattern across the width of the deck. The resulting deck is stiff in the longitudinal direction yet flexible with respect to rotation about the longitudinal axis. The deck is therefore flexible enough to enable the front and rear trucks to rotate with respect to one another while still being rigid enough to withstand the weight of the rider.

18 Claims, 11 Drawing Sheets

(56) References Cited

U.S. PATENT DOCUMENTS

| | | | | |
|---|---|---|---|---|
| 2011/0042913 | A1* | 2/2011 | Landau | A63C 17/015<br>267/285 |
| 2013/0001910 | A1* | 1/2013 | Hsu | A63C 17/014<br>280/87.042 |
| 2020/0155920 | A1* | 5/2020 | Li | A63C 17/015 |

* cited by examiner

SKATEBOARD DECK WITH LONGITUDINAL RIGIDITY AND TORSIONAL FLEXIBILITY

TECHNICAL FIELD

The invention generally relates to a skateboard. In particular, the invention relates to a skateboard deck that is rigid with respect to its longitudinal axis while still being flexible with respect to rotation about that longitudinal axis.

BACKGROUND

The prior art includes a wide variety of skateboard styles. The vast majority of these skateboards include a deck made from plywood. Plywood is a strong and durable material able to withstand the forces generated by various jumps and tricks. At a minimum, the size and thickness of the plywood deck is designed to support the weight of the rider with little sag in the longitudinal direction between the two trucks. A plywood deck, however, when made stiff enough to support the rider's weight, is so stiff that it largely prevents or inhibits axial rotation about the longitudinal axis. There is therefore a need for a skateboard deck that is stiff enough to support the rider while being flexible in other dimensions.

SUMMARY

The invention in the preferred embodiment features a novel skateboard deck that is longitudinally stiff and rotationally flexible. The skateboard deck comprises an elongated body having a top surface and a bottom surface, a plurality of ribs integral with the bottom surface, and a plurality of apertures oriented in rows. The plurality of ribs are oriented substantially parallel to the longitudinal axis. The plurality of apertures are oriented in at least three rows, each row of apertures being oriented substantially parallel to the longitudinal axis.

In one preferred embodiment, the plurality of apertures are oriented in five or more rows sequentially distributed across the width of the elongated body. In total, the skateboard can include at least eighteen apertures sequentially positioned from the nose to the tail. Each of the plurality of apertures is a circle, cylinder, or truncated cone running between the top surface and bottom surface, i.e., perpendicular to the elongated body. Each of the plurality of apertures is at least a half inch in diameter. Each aperture may also include a ring that projects above the elongated body to produce a traction pattern to prevent the user's feet from slipping off the deck. The number of apertures as well as the distribution of those apertures has a strong influence on the rotational flexibility of the skateboard deck.

The longitudinal flexibility, by contrast, is strongly controlled by a plurality of ribs that are substantially parallel to the longitudinal axis. The plurality of ribs may then run the full length of the board or run between a first truck base and a second truck base. In general, the plurality of ribs comprises at least three ribs. In other embodiments, the skateboard may include up to seven ribs. The thickness of the elongated body where it coincides with each of the plurality of ribs is at least a half inch. In some embodiments, at least a portion of the bottom surface is characterized by a sinusoidal profile from the left side to the right side of the elongated body.

In the preferred embodiment, the skateboard deck is composed of wood, polymer, metal, or other material commonly used for skateboard decks. In the case of polymer, the deck may include at least 20 percent glass fiber and at least 50 percent nylon. The resulting deck can be characterized by a rotational spring constant between 1.50 and 2.35 foot×pounds/degree, preferably 1.67 foot×pounds/degree plus or minus ten percent. The rotational spring constant is therefore less than a conventional plywood board having a rotational spring constant of about 2.45 foot×pounds/degree. The invention results in a board that dynamically conforms to the contours of the ground to provide an exciting experience for the user.

BRIEF DESCRIPTION OF THE DRAWINGS

The present invention is illustrated by way of example and not limitation in the figures of the accompanying drawings, and in which.

DETAILED DESCRIPTION OF THE PREFERRED EMBODIMENT

Figure 1:
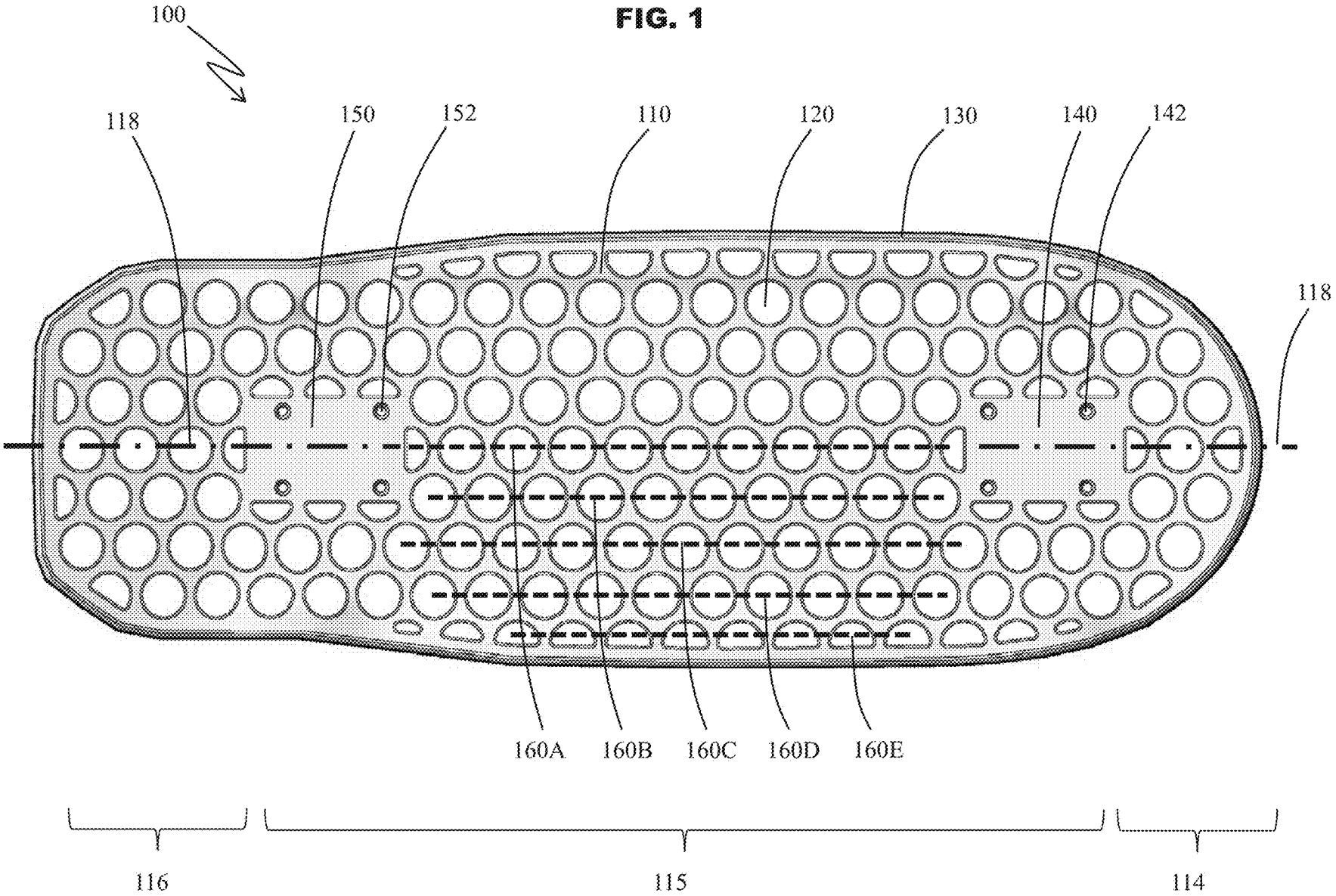
FIG. 1 is a top view of the skateboard deck, in accordance with a preferred embodiment of the present invention.
Figure 2:
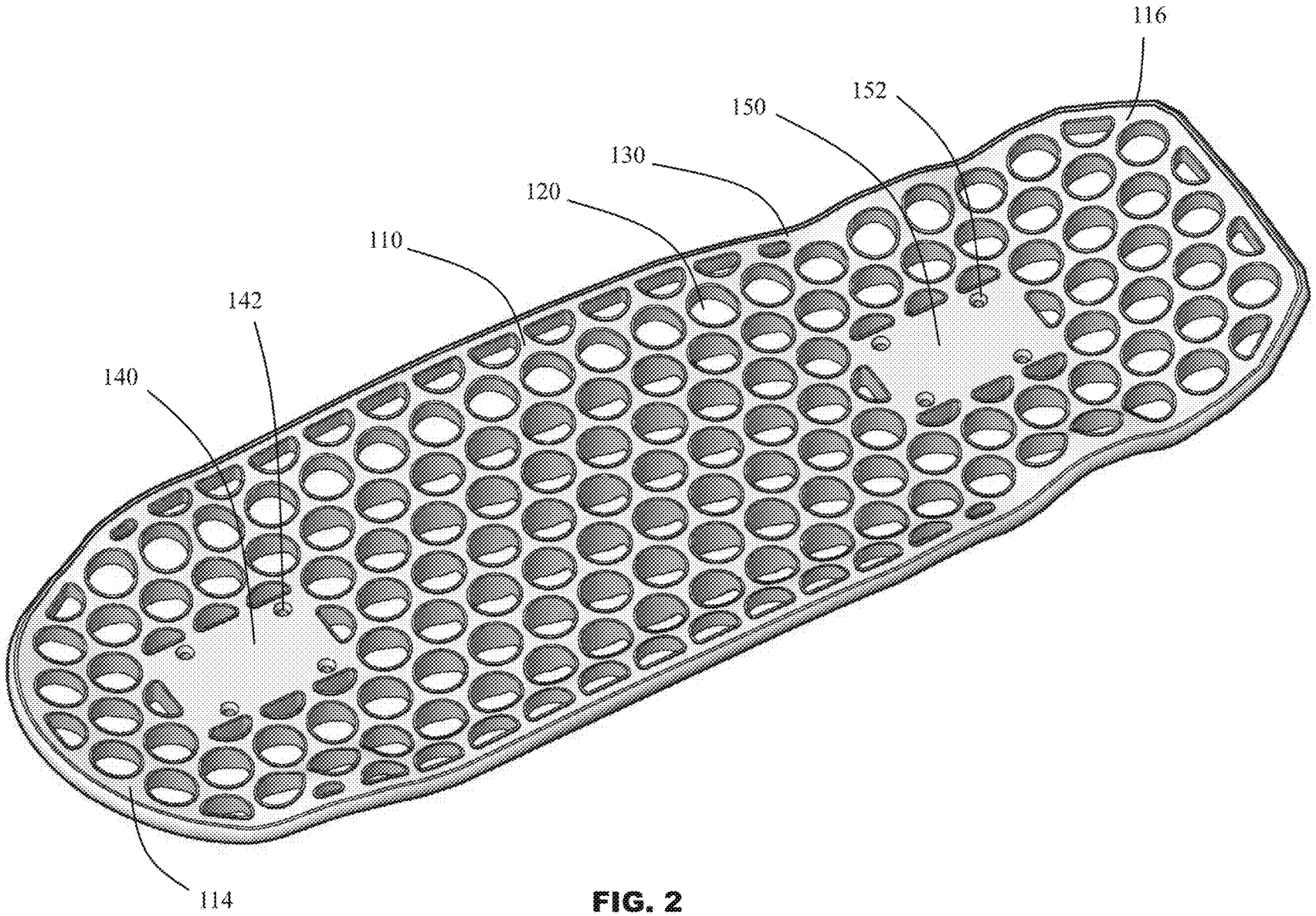
FIG. 2 is a perspective view of the top side of the skateboard deck, in accordance with a preferred embodiment of the present invention.
Figure 3:
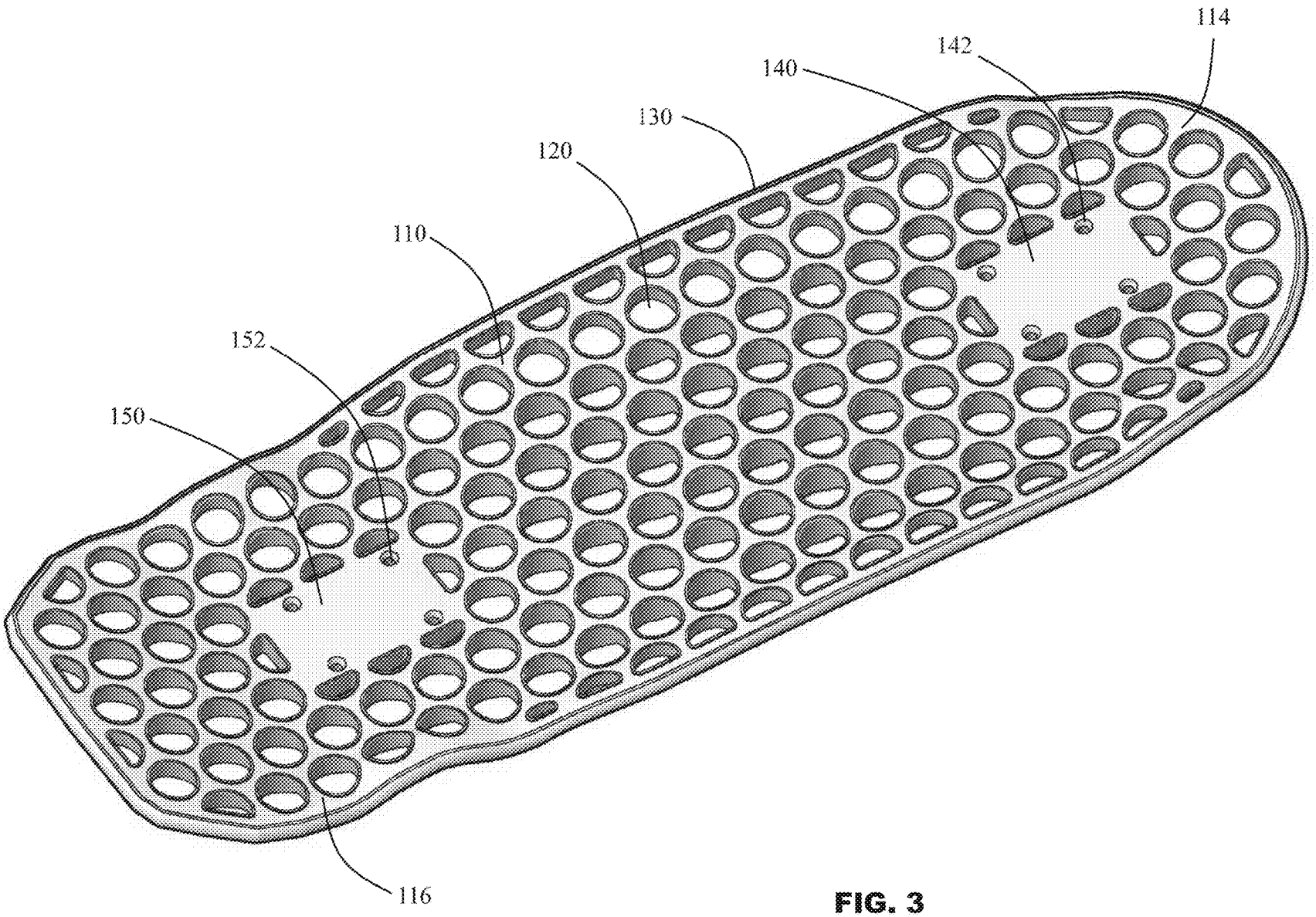
FIG. 3 is a perspective view of the top side of the skateboard deck, in accordance with a preferred embodiment of the present invention.

As illustrated in FIGS. 1-7, the invention in the preferred embodiment features a skateboard deck 100 comprising an elongated body having top surface 110, bottom surface 112, front portion 114, middle portion 115, and back portion 116.

The top 110 surface of the middle portion 115 of the elongated body is substantially flat although the deck 110 may be formed with a positive camber to accommodate flexing under the weight of the rider. The front portion 114 and back portion 116 can be angled upward with respect to the middle portion 115 to serve as kick plates.

The skateboard deck 100 further includes a first truck base 140 and second truck base 150 configured to receive and attach to trucks (not shown). The truck bases 140, 150 in the preferred embodiment are solid rectangular pads including a plurality of holes configured to receive bolts with which the trucks are mounted. The plurality of holes in the truck bases 140, 150 are typically 0.2 inches in diameter.

In the preferred embodiment, front portion 114, back portion 116, first truck base 140, and second truck base 150 are integrally formed into the deck 110 as are the bolt holes used to mount the trucks. The front portion 114 generally angles upward forward of the first truck base 140 while the back portion 116 angles upward aft of the second truck base 150.

Figure 7:
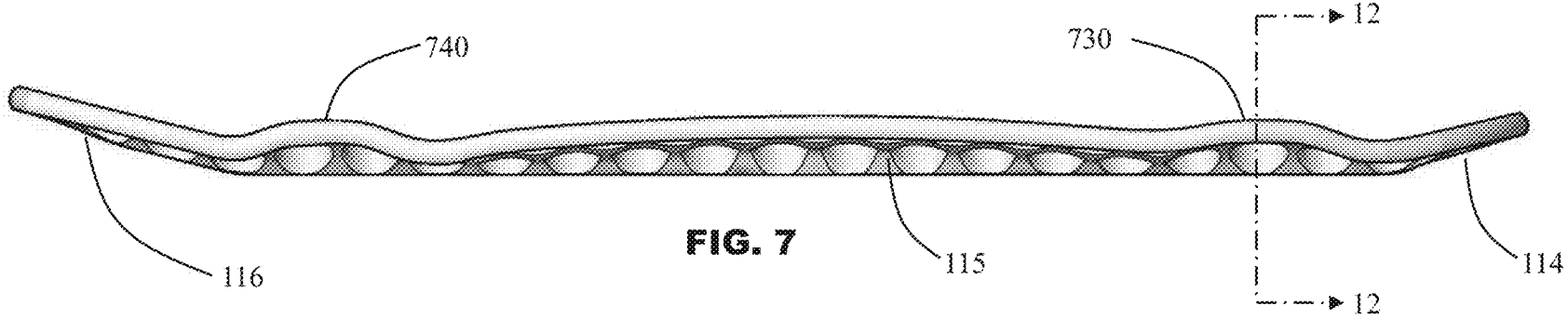
FIG. 7 is a side view of the skateboard deck, in accordance with a preferred embodiment of the present invention.

As illustrated in the side view in FIG. 7, The deck 100 may include wheel arches 730, 740 to maintain clearance with respect to the skateboard wheels (not shown) when the skateboard is made to turn. The position and depth of the wheel arches 730, 740 generally depends on the style of board and types of trucks employed with the skateboard deck 100.

The skateboard deck 100 in the preferred embodiment is configured to be relatively stiff with respect to linear flexure along the longitudinal axis 118 while still being relatively flexible with respect to rotational flexure about the longitudinal axis 118. That is, the deck bends relatively little under the weight of the rider, while still bending in a rotational manner about the longitudinal axis, i.e., rotation of the front portion 114 relative to the back portion 115 about the longitudinal axis 118. Stated differently, the linear spring constant of the deck 100 in the longitudinal direction is relatively large while the rotational spring constant characterizing rotation of the deck about the longitudinal axis is relatively small, as compared to traditional skateboard decks.

Figure 4:
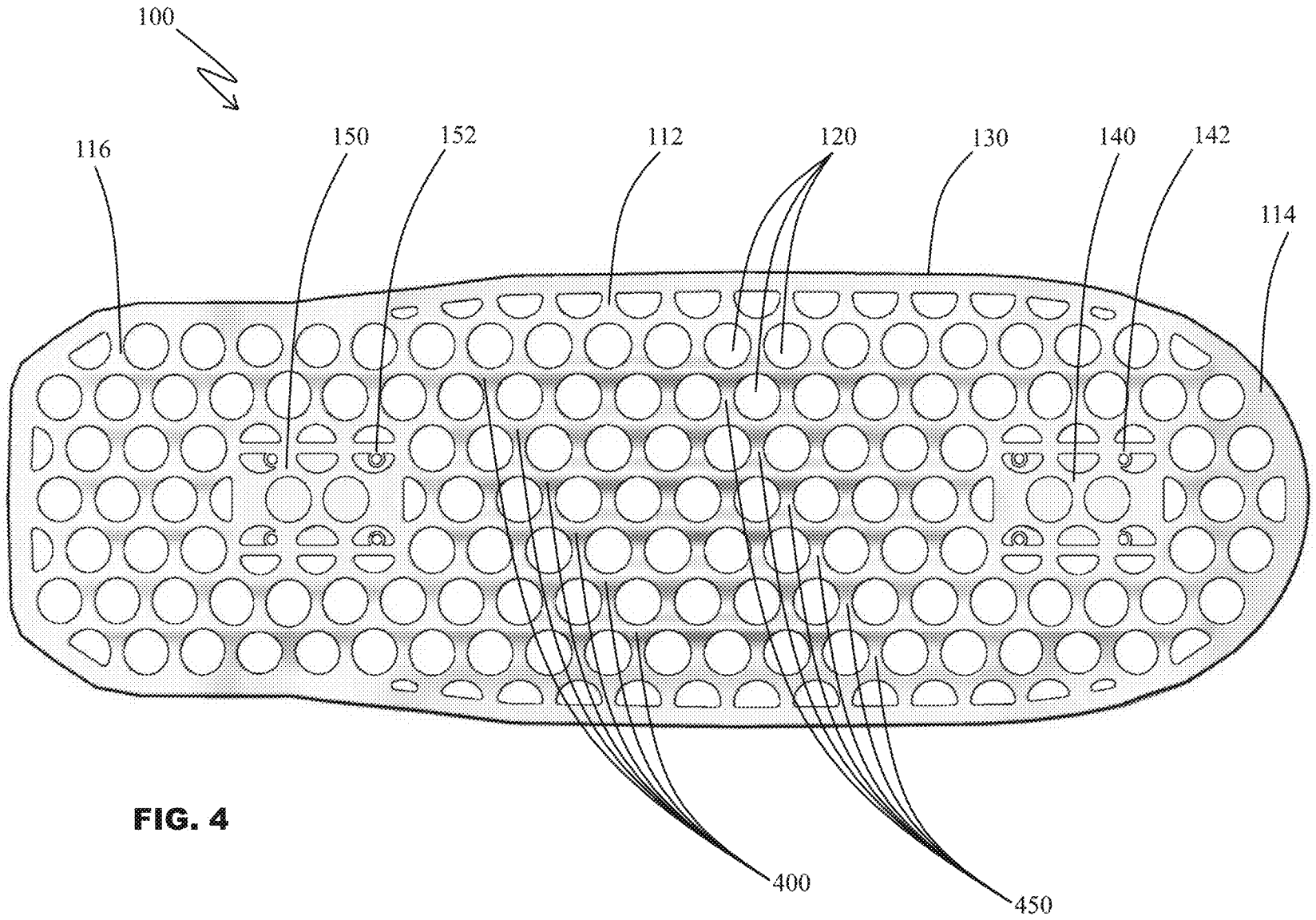
FIG. 4 a bottom side view of the skateboard deck, in accordance with a preferred embodiment of the present invention.
Figure 5:
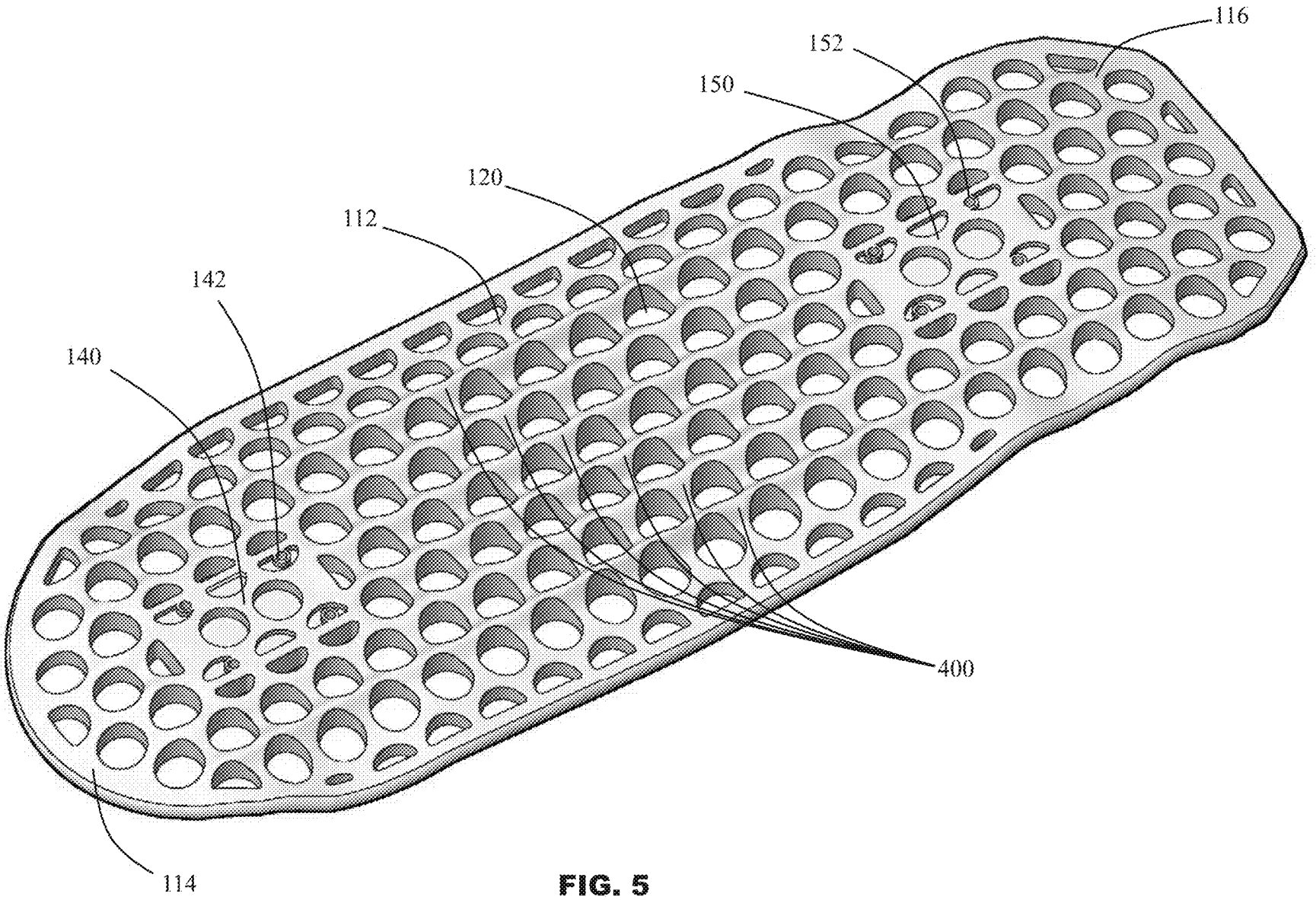
FIG. 5 is a perspective view of the bottom side of the skateboard deck, in accordance with a preferred embodiment of the present invention.
Figure 6:
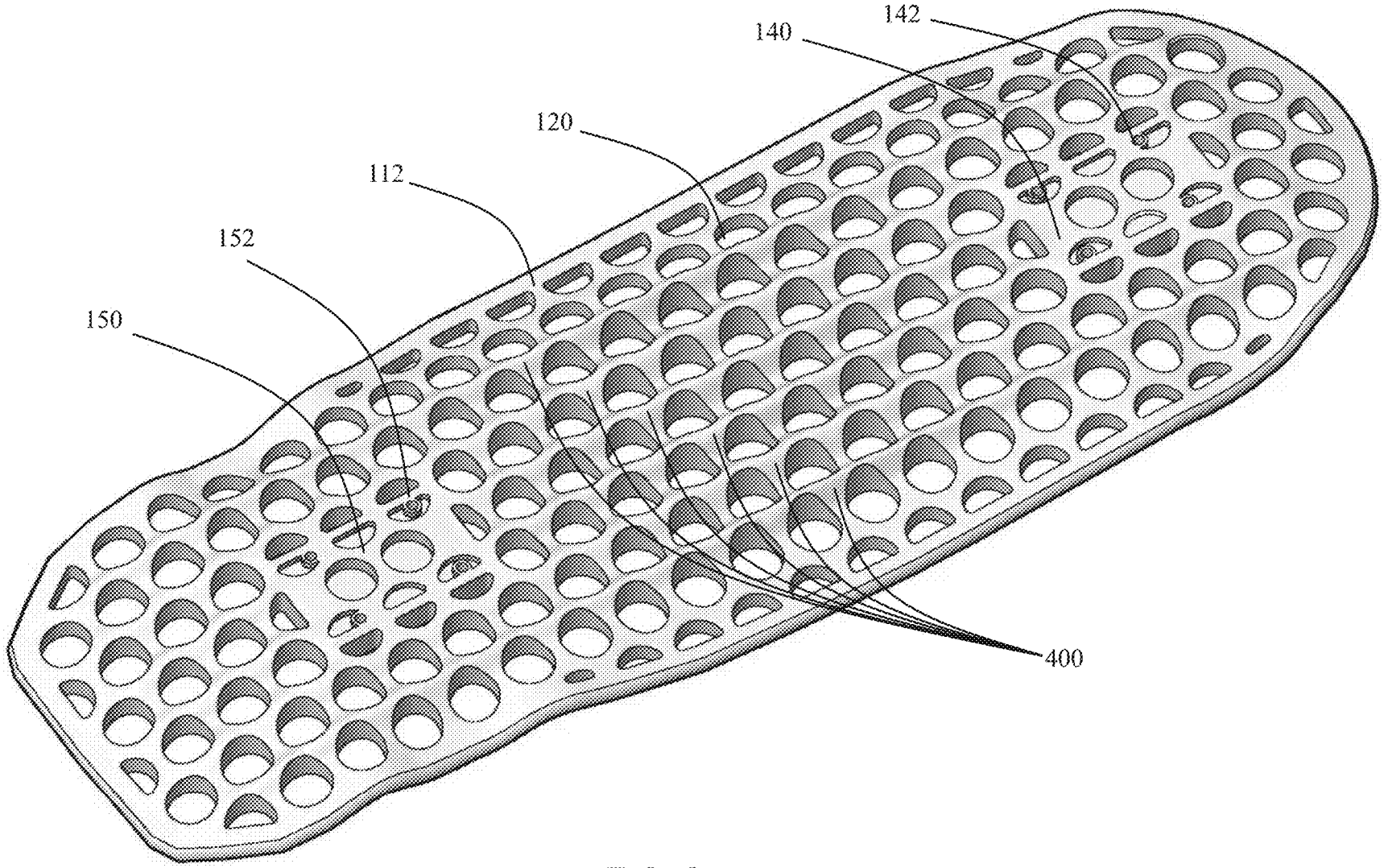
FIG. 6 is a perspective view of the bottom side of the skateboard deck, in accordance with a preferred embodiment of the present invention.
Figure 12:
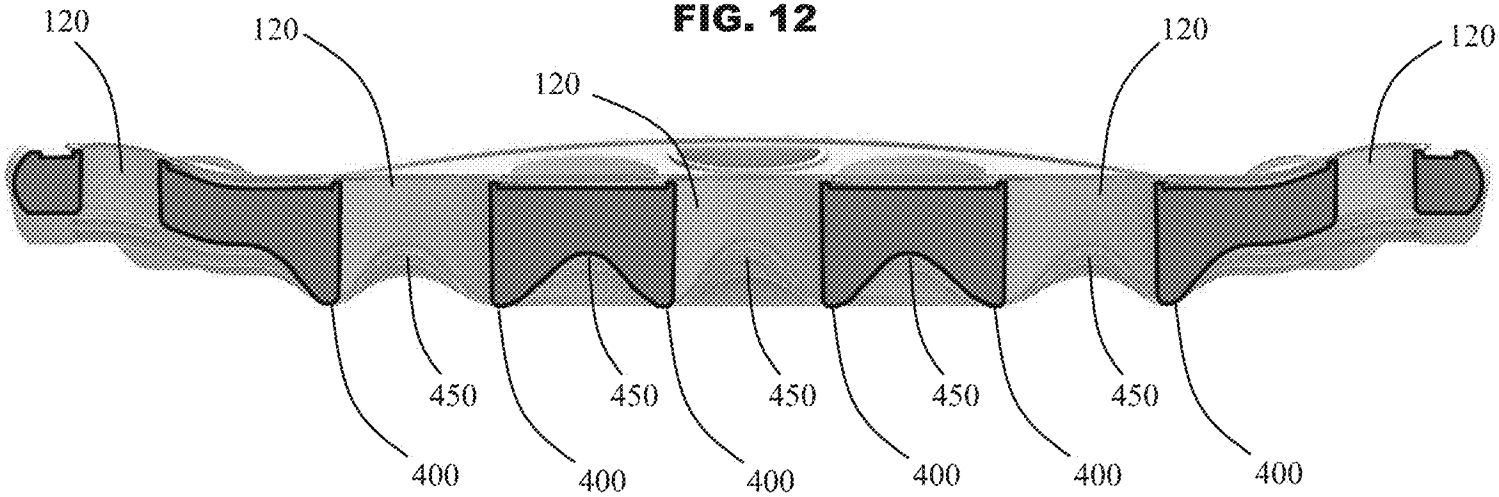
FIG. 12 is a lateral cross section of the skateboard deck, in accordance with a preferred embodiment of the present invention.
Figure 13:
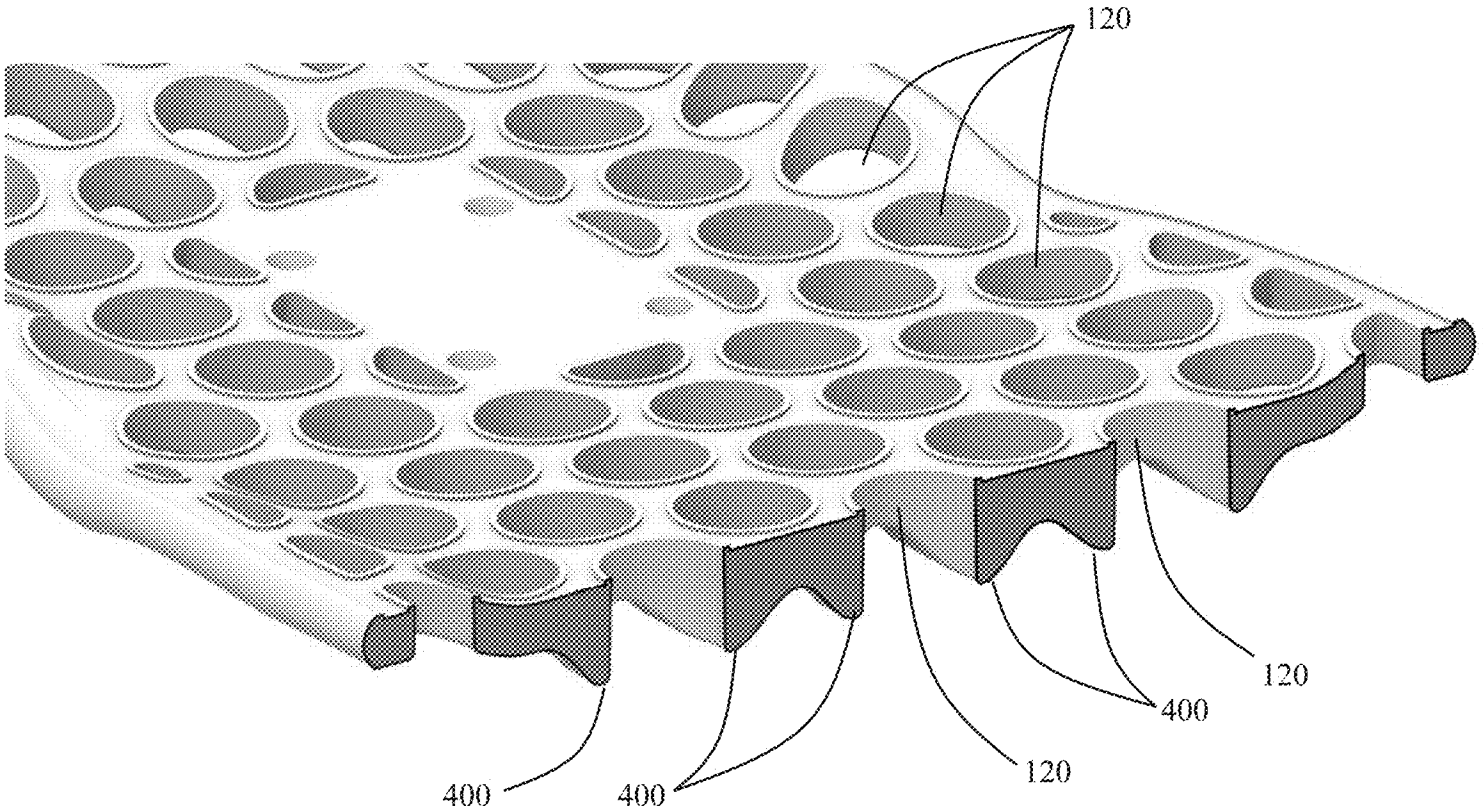
FIG. 13 is a perspective view of a lateral cross section of the skateboard deck, in accordance with a preferred embodiment of the present invention.
Figure 14:
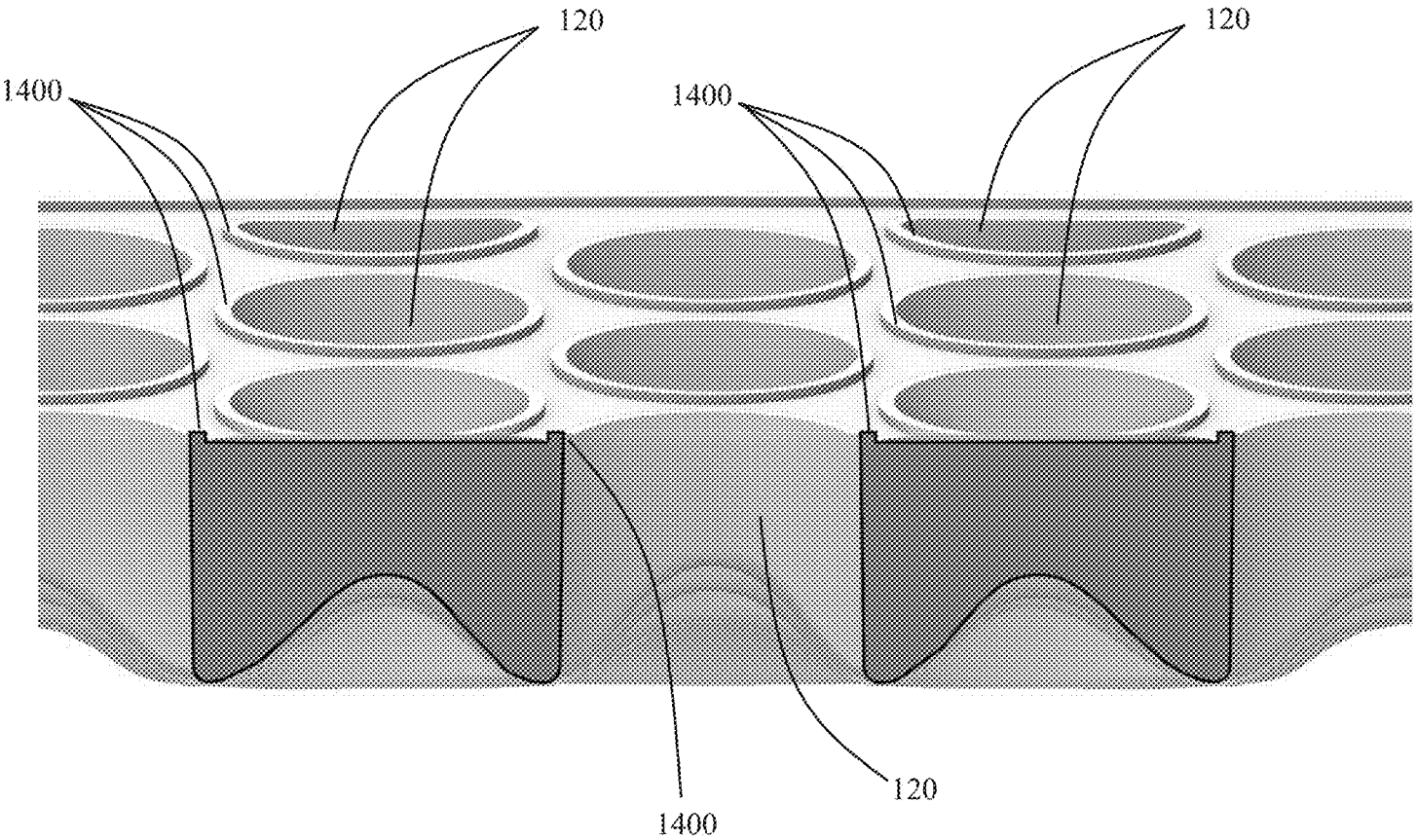
FIG. 14 is a side view of a lateral cross section of the skateboard deck, in accordance with a preferred embodiment of the present invention.

In the preferred embodiment, linear flexure (i.e., non-rotational flexure) along the longitudinal axis is based on a plurality of ribs 400, as illustrated in perspective view in FIGS. 4-6 and cross section in FIGS. 12-14. Each of the ribs 400 serves as a structural element configured to stiffen the skateboard deck 100. Between the ribs 400 are a plurality of recessed channels 450. The ribs 400 generally extend downward from the bottom surface 112 of the deck and/or downward with respect to the recessed channels 450. The ribs 400 and channels 450 are generally parallel and run lengthwise between the first truck base 140 and second truck base 150. In some other embodiments, the ribs 400 and channels 450 run the full length of the deck 100 between the leading edge of the front portion 114 and back portion 116.

Figure 8:
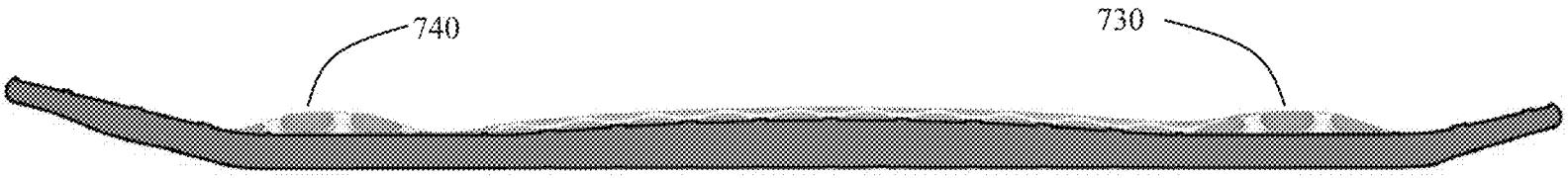
FIG. 8 is a longitudinal cross section through a rib of the skateboard deck, in accordance with a preferred embodiment of the present invention.

In the preferred embodiment, the deck 100 includes a set of six ribs that protrude downward from the underside 112 of the deck 100. The ribs 400 extend downward with respect to the recessed channels 450 between one-fourth inch and 1.25 inches, preferably three-eighths of an inch. A typical rib 400 is shown in cross section in FIG. 8. In the preferred embodiment, the overall thickness of the ribs 400 and deck 100 is approximately 0.8 inches at the center of the deck 100, and approximately 0.5 inches in proximity to the truck bases 140, 150. The resulting bottom edge of the rib 400 is substantially flat while the top surface 112 of the deck is curved upward in the middle to produce a positive camber.

Figure 9:
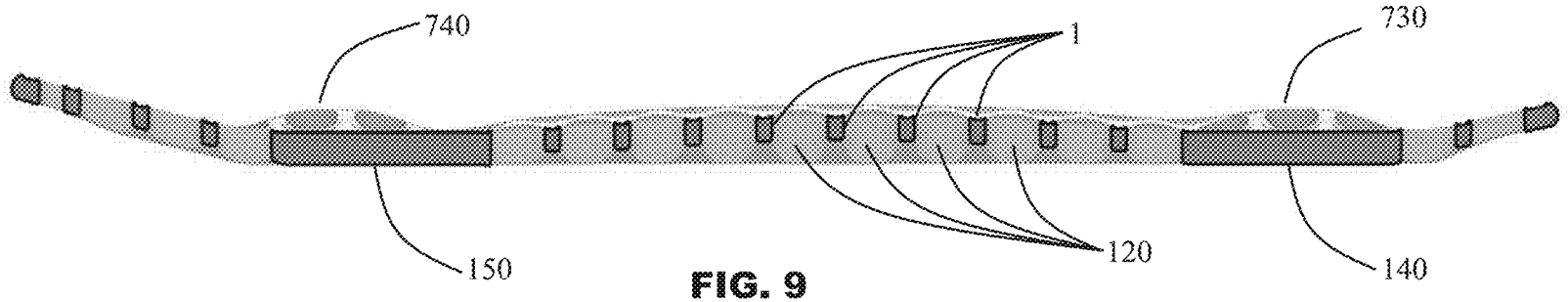
FIG. 9 is a longitudinal cross section through a set of apertures in the skateboard deck, in accordance with a preferred embodiment of the present invention.
Figure 11:
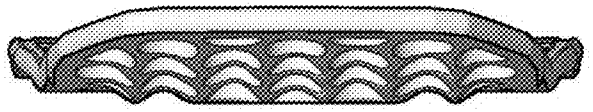
FIG. 11 is a back side view of the skateboard deck, in accordance with a preferred embodiment of the present invention.
Figure 10:
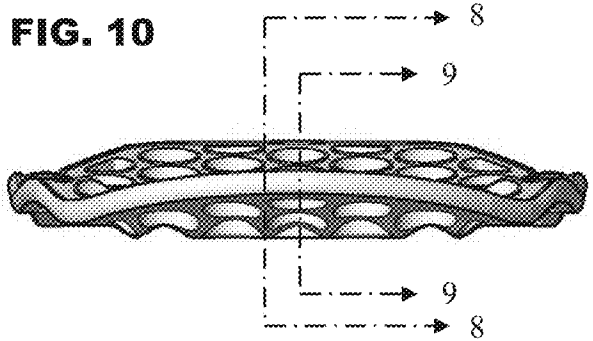
FIG. 10 is a front side view of the skateboard deck, in accordance with a preferred embodiment of the present invention.

A typical recessed channel 450 is shown in cross section in FIG. 9. In the preferred embodiment, the overall thickness of the deck 100 coinciding with each channel 450 is approximately 0.5 inches from the first truck base 140 to the second truck base 150.

Illustrated in FIGS. 12-13 is a cross section of the deck 100 perpendicular to the longitudinal axis 118. As shown in this lateral profile, the top surface 100 is substantially flat in the space between the wheel arches 730. In contrast, the bottom surface 112 through the ribs 400 and channels 450 is substantially sinusoidal, causing the vertical thickness of the deck 100 to be maximal at the apex of each rib 400 and minimal at the apex of a channel 450.

The rigidity of the deck 100 with respect to the longitudinal axis 118 is also based, in part, on the material from which the deck is made as well as the number and thickness of the ribs 400. Increasing the thickness of the deck 100 and/or increasing the number of ribs 400 increases the lengthwise stiffness of the deck with respect to the longitudinal axis 118. The deck 110 and ribs 400 in the preferred embodiment are made of a polymer that is manufactured through an injection-molded process known to those of ordinary skill in the art.

In the preferred embodiment, rotational flexure along the longitudinal axis is controlled by a plurality of perforations or apertures 120, as illustrated in FIGS. 1-14. The plurality of apertures 120 run vertically through the deck 100 from the top 110 surface to the bottom surface 112. These apertures 120 are substantially circular, cylindrical, or conical in shape. In other embodiments, the apertures are characterized by more complex profiles including ovals, rectangles, diamonds, pentagons, hexagons, and other polygons that run vertically from the top surface of the deck to the bottom surface. In the preferred embodiment, the apertures 120 coincide with the recessed channels 450, thereby leaving the ribs 400 intact. As a result, the deck 100 can be characterized as an alternating series of ribs and 400 and rows 160A-160E of apertures across the width of the deck 100.

In the preferred embodiment, the apertures 120 are between a half inch and one and a quarter inch in diameter, preferably 0.93 inches in diameter. The spacing between the center points of two adjacent holes is approximately 1.2 to 1.3 inches, although this distance may vary widely. The plurality of apertures 120, as defined herein, exclude the bolt holes in the first truck base 140 and second truck base 150.

As illustrated in FIG. 1, the apertures 120 are distributed in linear rows, groups, or arrays 160A-160E. The apertures of a row generally run linearly in a straight line from the front of the deck to the back. In the preferred embodiment, rows of apertures 120 run sequentially from the left rail to the right rail, each individual row of apertures running the entire length of the deck 100. The plurality of rows 160A-160E are, in the preferred embodiment, substantially parallel to the longitudinal axis 118.

The distance between adjacent apertures 120 of a particular row is substantially equal to the spacing between apertures from the two adjacent rows 160A-160E. The pattern of apertures of the two adjacent rows 160A-160E is, however, staggered to increase the packing density of apertures. As a result, the density of apertures running the length of the deck 100 is different than the density of apertures running the width of the deck. In other embodiments, the apertures 120 are not staggered, thus giving rise to a pattern of apertures 120 that is uniform in two-dimensions. In all, the deck 100 shown in FIG. 14 includes approximately 170 full and partial apertures 120.

Each aperture 120 serves to reduce the physical attachment between the portions of deck 100 on either side of an aperture. As a result, the portions of deck on opposing sides of an aperture are able to flex relative to one another more freely. Similarly, groups of apertures 160A-160E serve to reduce the physical attachment between portions of deck 100 to the front and rear of any given group of apertures. As a result, each group of apertures 160A-160E relaxes, i.e., reduces, the rotational rigidity of the deck 100 along the longitudinal axis 118. The relaxed rotational rigidity—in combination with the enhanced linear rigidity produced by the ribs 450—permit the deck to rotate in a helical manner about the longitudinal axis 118 while still carrying the weight of the rider.

Figure 15:
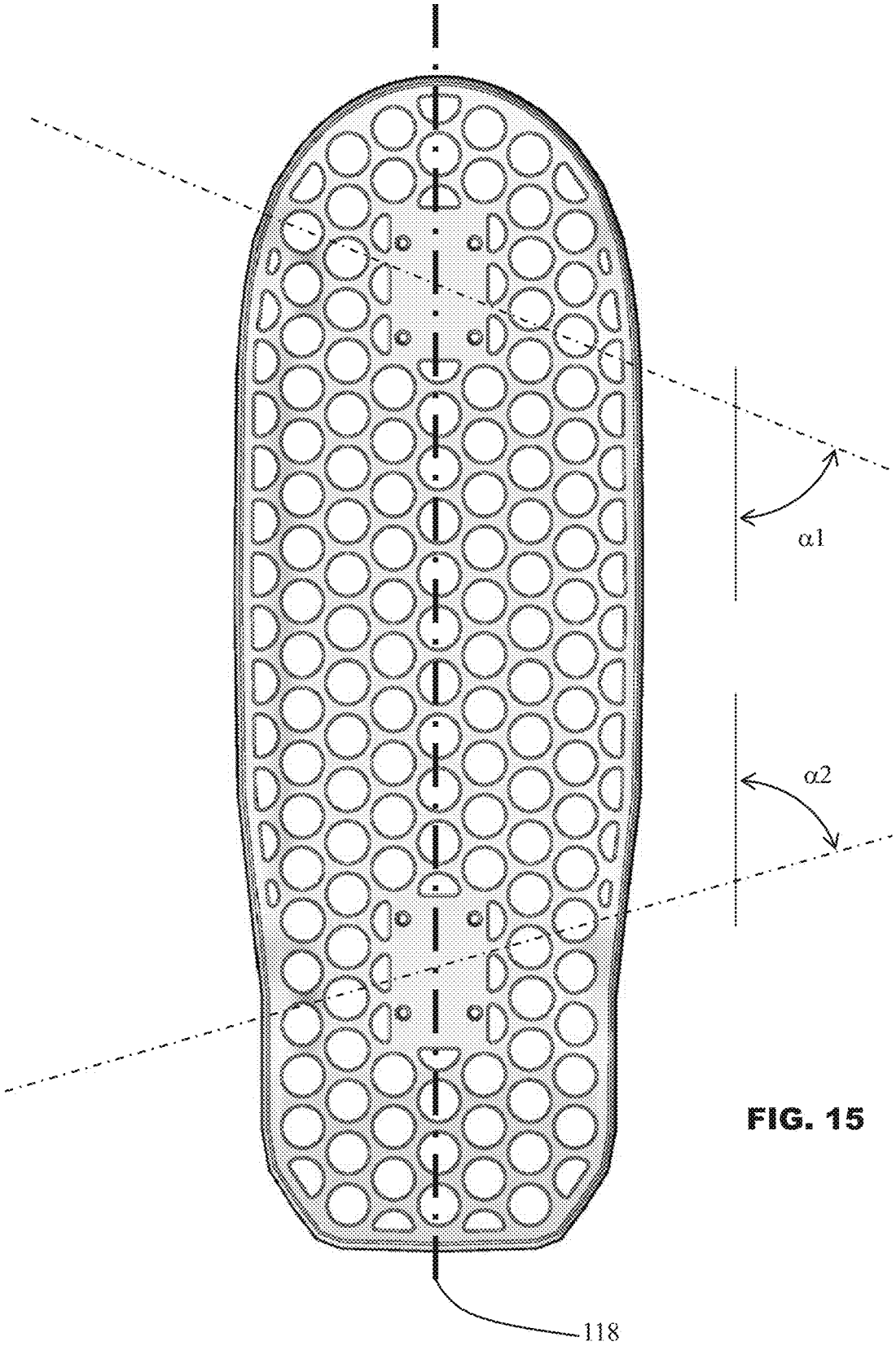
FIG. 15 is a top view of the skateboard deck showing the orientation of the front and rear axles, in accordance with a preferred embodiment of the present invention.

The resulting deck 100 permits the front portion 114 to rotate longitudinally, to a small degree, independently of the back portion 116 of the deck. More specifically, the deck 100 permits the front truck base 140 to rotate longitudinally, to a small degree, independently of the rear truck base 150. Since the rotation of an axle in a horizontal plane depends on the longitudinal rotation of the truck base to which it is attached, the front axle (not shown) rotates differently than the rear axle (not shown) in a horizontal plane. Referring to FIG. 15, for example, let angle $\alpha 1$ represent the change in orientation of the front axle in a horizontal plane when making a right turn, and let $\alpha 2$ represent the change in orientation of the rear axle in a horizontal plane when making the same right turn. In a skateboard deck with little or no rotational flexibility, angles $\alpha 1$ and angle $\alpha 2$ are substantially equal. In the present invention, in contrast, angles $\alpha 1$ and angle $\alpha 2$ can be markedly different due to the rotational flexure of the deck 100. This rotational flexure thus enhances the turnability of the resulting skateboard as well as the ability of the board to be driven through a particular trajectory desired by its rider. This level of turnability and drivability is unparalleled in the prior art.

In the preferred embodiment, the angular rotation of the front truck base 140 relative to the rear truck base 150 can be characterized by a rotational spring constant. The rotational spring constant of the deck 100—as measured between the truck bases 140, 150—is in the range of 1.5 to 2.0 foot pounds/degree (ft·lbs./deg.), preferable 1.67 ft·lbs./deg. By way of contrast, the rotational spring constant of a convention plywood board is about 2.45 ft·lbs./deg. In some "stiffer" versions of the present invention, the rotational spring constant of the deck 100 is in the range of 1.5 to 2.35 ft·lbs./deg.

Referring to the cross section of FIG. 14, the deck 100 includes a traction pattern to increase friction and reduce the risk of the user's feet from slipping off the deck. The traction pattern comprises a plurality of raised rings 1400 concentrically aligned with the upper edge of each aperture 120. Each ring 1400 has a height of approximately 0.031 inches above the top surface 110 of the deck and a width of approximately 0.058 inches. In addition to traction, the plurality of rings 1400 enhance the aesthetic appeal of the cylindrical apertures 120.

The skateboard deck 100 in the preferred embodiment is approximately twenty-six inches long with respect to the longitudinal axis 118, approximately nine inches wide, and approximately ⅜ inches thick at its narrowest point, although these dimensions may vary widely based on the type of skateboard. The invention may be implemented with a wide range of skateboards including standard shortboards, longboards, cruisers, and mini cruisers, for example.

The skateboard deck in the preferred embodiment is made of a synthetic polymer comprising at least 20 percent glass fiber, at least 50 percent nylon, and an ultraviolet inhibitor additive, although other percentages and other components still fall within the scope of this invention. In still other embodiments, the skateboard deck may comprise metal such as steel or aluminum, or wood and/or plywood components.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

We claim:

1. A skateboard deck comprising:

an elongated body comprising a top surface and a bottom surface, wherein the elongated body is characterized by a longitudinal axis;

a plurality of ribs integral with the bottom surface, each rib oriented substantially parallel to the longitudinal axis; and a plurality of apertures oriented in at least three rows, each row of apertures being oriented substantially parallel to the longitudinal axis, wherein each of the plurality of apertures is at least a half inch in diameter.

2. The skateboard deck of claim 1, wherein the plurality of apertures are oriented in at least five rows sequentially distributed across the elongated body.

3. The skateboard deck of claim 1, wherein each of the plurality of apertures is a circle running between the top surface and bottom surface.

4. The skateboard deck of claim 3, wherein each of the plurality of apertures includes a raised surface around the aperture that projects above the elongated body to produce a traction pattern.

5. The skateboard deck of claim 3, further comprising a first truck base and a second truck base; and wherein the plurality of ribs comprises at least three ribs, each rib running from at least the first truck base to the second truck base.

6. The skateboard deck of claim 5, wherein a thickness of the elongated body at one of the plurality of ribs is at least a half inch.

7. The skateboard deck of claim 1, wherein the elongated body comprises a nose, a tail, a left side, and a right side; wherein the plurality of apertures comprises at least fifteen apertures sequentially positioned from the nose to the tail, and at least five apertures sequentially positioned from the left side to the right side.

8. The skateboard deck of claim 7, wherein at least a portion of the bottom surface is characterized by a sinusoidal profile from the left side to the right side of the elongated body.

9. The skateboard deck of claim 1, wherein the skateboard deck is characterized by a rotational spring constant between 1.50 and 2.0 foot pounds/degree.

10. The skateboard deck of claim 1, wherein the skateboard deck is characterized by a rotational spring constant between 1.50 and 2.35 foot pounds/degree.

11. The skateboard deck of claim 1, wherein each of the plurality of apertures is characterized by at least one polygon, and the deck further comprises a traction pattern, wherein the traction pattern is characterized by said at least one polygon.

12. A skateboard deck comprising:

an elongated body comprising a top surface and a bottom surface, wherein the elongated body is characterized by a longitudinal axis;

a plurality of ribs integral with the bottom surface, each rib oriented substantially parallel to the longitudinal axis; and a plurality of apertures oriented in at least three rows, each row of apertures being oriented substantially parallel to the longitudinal axis, wherein each of the plurality of apertures is at least a half inch in diameter;

wherein at least one of the plurality of ribs is interposed between two rows of apertures, and at least one row of apertures is interposed between two of the plurality of ribs.

13. The skateboard deck of claim 12, wherein the plurality of ribs comprises at least two ribs, and the plurality of apertures are arranged in at least seven rows.

14. The skateboard deck of claim 13, wherein the plurality of apertures are characterized by cylinders or truncated cones.

15. The skateboard deck of claim 14, wherein the deck is composed of metal.

16. The skateboard deck of claim 14, wherein the deck is composed of polymer.

17. The skateboard deck of claim 16, wherein the polymer comprises at least 20 percent glass fiber and at least 50 percent nylon.

18. The skateboard deck of claim 12, wherein the skateboard deck is characterized by a rotational spring constant 1.67 foot pounds/degree.

* * * * *